US005847732A

United States Patent [19]

Shinozaki et al.

[11] Patent Number: 5,847,732

[45] Date of Patent: Dec. 8, 1998

[54] RECORDING DEVICE

[75] Inventors: Kenji Shinozaki; Hideki Hirano, both of Kanagawa, Japan

[73] Assignee: Sony Corporation, Tokyo, Japan

[21] Appl. No.: 524,571

[22] Filed: Sep. 7, 1995

[30] Foreign Application Priority Data

Sep. 9, 1994 [JP] Japan ..... 6-242210

[51] Int. Cl.[6] ..... B41J 2/005

[52] U.S. Cl. ..... 347/51

[58] Field of Search ..... 347/51

[56] References Cited

U.S. PATENT DOCUMENTS

| | | | |
|---|---|---|---|
| 4,740,801 | 4/1988 | Shimazaki . | |
| 4,751,532 | 6/1988 | Fujimura et al. | 347/51 |

FOREIGN PATENT DOCUMENTS

| | | |
|---|---|---|
| 0 243 117 A2 | 10/1987 | European Pat. Off. . |
| 0 495 623 A1 | 7/1992 | European Pat. Off. . |
| 0 608 881 A2 | 8/1994 | European Pat. Off. . |
| 0 609 149 A2 | 8/1994 | European Pat. Off. . |
| 63-095951 | 4/1988 | Japan . |
| 04080089 | 3/1992 | Japan . |
| 04212863 | 8/1992 | Japan . |
| 06071874 | 3/1994 | Japan . |

*Primary Examiner*—Valerie Lund
*Attorney, Agent, or Firm*—Hill & Simpson

[57] ABSTRACT

During the recording where a liquid dye 22 supplied through a dye passage 27 is supplied to a vaporizing means 17 due to the capillarity of many small columns 21 within a vessel formed by coupling of a glass base 14 and a Teflon protection plate 290, the liquid dye in the vaporizing means is vaporized by irradiation of the laser beam L and the vaporized dye is transmitted to a photographic paper 50 passing a vaporization hole (aperture) 23 for the purpose of recording. The protection plate 290 has a critical surface tension against the liquid dye which is smaller than a surface tension of the liquid dye.

Since the critical surface tension of the protection plate 290 is set smaller than a surface tension of the liquid dye, wettability of the liquid dye against the internal wall surface of the vaporizing hole 23 is low and the liquid dye left unvaporized at the vaporizing hole 17 at the time of recording is never deposited on the internal wall surface of the vaporizing hole. Therefore, the vaporizing hole is always kept clear, transfer of the vaporized dye 32 to the photographic paper is never prevented due to deposition of dye to the vapotizing hole and thereby excellent recording quality can always be guaranteed.

11 Claims, 13 Drawing Sheets

FIG. 14A
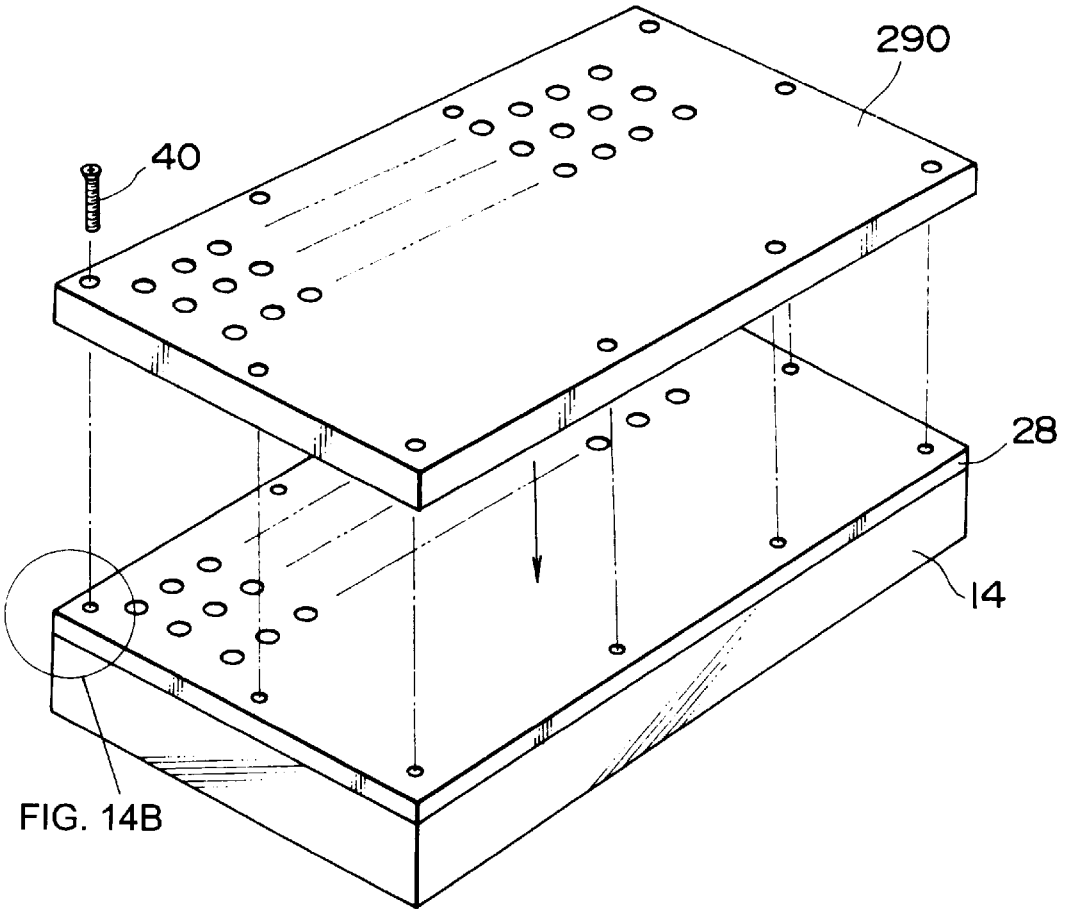
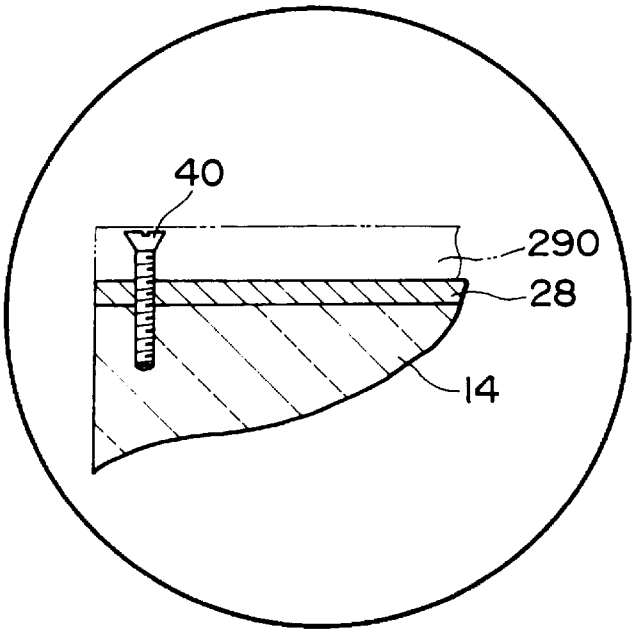
FIG. 14B

RECORDING DEVICE

BACKGROUND OF THE INVENTION

1. Field of the Invention

The present invention relates to a recording device and a recording method using this recording device.

2. Description of Related Art

With recent rapid progress in color video recording systems such as video cameras, televisions and computer graphics, etc., a requirement for colored hard copy is quickly growing. Considering such background, many color printers of various systems have been developed and used in various fields.

Of these recording systems, there is provided a system in which an ink sheet which is coated with an ink layer where high concentration transfer dye is dispersed into an adequate binder resin and a receiver material such as photographic paper which is coated with dye receiving resin as a reservoir for transferred dye are set in close contact with a constant pressure, heat is applied thereto depending on video information from a thermosensitive recording head located on the ink sheet and the transfer dye is thermally transferred depending on the amount of heat applied to the image receiving layer from the ink sheet.

A so-called thermal transfer system, which is characterized in that a full-color image having continuous gradation can be obtained by repeating the operations explained above for the video signals decoded into three primary colors in subtractive mixture, that is, yellow, magenta and cyan, is attracting considerable attention as an excellent technique which can be put into practical use in small size ensuring easier maintenance work to obtain, on the realtime basis, a high quality image like a silver-salt color photographic image.

FIG. 16 is a schematic front elevation diagram of the essential portion of a thermal transfer system printer.

The thermosensitive recording head (hereinafter called a thermal head) 61 and a platen roller 63 are provided opposed with each other, an ink sheet 62 where an ink layer 62*a* is laid on a base film 62*b* and a recording sheet (receiver material) 70 where a dye receiving resin layer 70*a* is laid on a paper sheet 70*b* are provided therebetween, and these ink sheet 62 and recording sheet 70 are pressed toward the thermal head 61 by the platen roller 63.

The ink (transfer dye) in the ink layer 62*a* which is selectively heated by the thermal head 61 is transferred dot by dot to the dye receiving resin layer 70*a* of the receiver material 70 to perform the thermal transfer recording. Such thermal transfer recording generally employs a line system where a long-length thermal head is fixed for arrangement perpendicular to the running direction of the recording sheet.

However, this system has following disadvantages.

① Since an ink sheet as an ink supply material is manufactured to be used once for the printing and thereafter to be disposed, the ink sheets appear as a large amount of waste after the printing, resulting in a problem for energy saving and environmental protection. Moreover, the dye dispersed in the ink sheet is generally used for the actual printing in the rate of 10% or less and unused dye is wasted together with the ink sheet bringing about increase in the running cost of the printing.

② In view of reducing the amount of waste, a means for obtaining a full-color image through multiple use of ink sheet has been proposed. However, since the transfer dye layer and the receiver material are placed in the close contact, when the transfer dye A is first transferred to the receiver material and the transfer dye B is then transferred thereto, the transfer dye A on the receiver material is reversely transferred to the layer of transfer dye B of the ink sheet, contaminating the transfer dye B. Therefore, the printing quality of the second and subsequent sheets may be deteriorated.

③ Since the ink sheet has a large volume, it limits on realization of a small size and light weight printer.

④ A so-called thermal transfer system is actually a transfer mechanism utilizing the thermal transfer phenomenon of dye. Therefore, an image receiving layer also has to be heated sufficiently for realizing dispersion of dye into the image receiving layer of the receiver material and thereby thermal efficiency becomes bad.

⑤ The ink sheet and receiver material must be pressed with a higher pressure for highly efficient transfer. Therefore, the printer is requested to have a rigid structure, giving restriction for realization of small size and light weight printer.

⑥ Transfer sensitivity may be improved by enhancing phase solubility between dye receiving layer of receiver material and transfer dye. However, the dye receiving resin having a higher compatibility with the transfer dye is generally inferior in stability for storing and particularly in optical stability.

As listed above, the so-called thermal transfer system has various disadvantages. Therefore, it has strongly been expected to develop the technique for manufacturing a small size and light weight printer by reducing an amount of waste and transfer energy while maintaining various merits explained above.

SUMMARY OF THE INVENTION

The inventors of the present invention have succeeded, after long-term researches and investigations, in disclosing a recording system as shown in FIG. 17 as a thermal recording system to meet the requirements explained above.

In this system, a fine gap is provided between a recording head unit comprising a dye layer having thermal solubility and a recording sheet 50 having a dye receiving layer to receive the dye provided opposed to the recording head. Thus, the liquefied dye 22 on the recording means is selectively vaporized by an adequate heating means such as a laser L, etc. and is then caused to transmit through the gap to form an image having the continuous gradation on the recording sheet 50. This operation is respectively repeated for the video signals decoded into the three primary colors in subtractive mixture, that is, yellow, magenta and cyan to obtain a full-color image on the recording sheet.

In this recording system, it is preferable that a photographic paper 50 is provided opposed to a recording head 10, for example, in the upper side thereof and the area near the surface of the vaporizing means 17 irradiated with the laser beam L which is emitted from a laser 18 and condensed by a lens 19, causing the vaporized dye 32 to fly over or transmit to the upper side. In this case, for successful transmission of the transfer dye through the gap 11 with the heating means, the phenomenon, which can often be seen when a high output laser is irradiated, that coupling of dye moleculars is effectively isolated and etching is performed at a very higher velocity using such decoupling energy and the phenomenon that etching is performed at a very higher velocity using an energy of gas generated by boiling or explosion can be utilized (the transfer mechanism other than such vaporization mechanism is called abrasion), as well as the vaporization phenomenon.

Moreover, a dye reservoir 15 is provided to a head base 14 having the laser beam transmitting property, a liquefied dye 22 is accommodated between such head base and a spacer 28 fixed thereon and the liquefied dye 22 is supplied to the vaporizing means 17 through a dye passage 27. In this case, for improvement of feeding efficiency of dye to the vaporizing means 17 and vaporization efficiency, fine unevenness formed of small columns 21 is provided at the vaporizing means 17 to supply and maintain the dye by making use of the capillarity.

In view of holding the above-mentioned gap 11 and guiding the photographic paper 50 moving in the direction X, a protection plate 29 is fixed on the spacer 28. A heater 16 is embedded in the protection plate 29 for maintaining the liquid condition of dye, but such heater may also be provided within the dye accommodating means (dye passage 27 and dye reservoir 15 explained above).

Considering a printer as a whole including this printer head, the dye reservoirs 15Y, 15M, 15C for yellow, magenta and cyan are respectively provided in the common base 14 for the full-color printing and each dye for each color is supplied therefrom to the vaporizing means 17Y, 17M, 17C arranged on a line forming as many as 12 to 24 dots.

Each vaporizing means is irradiated with each laser beam which is emitted from a multilaser array 30 composed of corresponding 12 to 24 lasers 18 (particularly, semiconductor laser chips) arranged in the shape of an array and is then condensed by a microlens array 31 formed of many condenser lenses 19.

In this system, since the dye used during the recording includes little binder resin, it can be supplied continuously to the recording head by making the dye in such amount as being lost flow into the transfer means under the fluid condition from the dye reservoir or by continuously coating an adequate base material with the dye of such amount and transmitting such base material to the recording means. Therefore, the recording head means can be used for several times in principle, thereby solving the problem ①.

Moreover, since the dye layer is isolated from the recording sheet, the problem ② that the recording dye which has been transferred to the recording sheet is reversely transferred to the different recording dye layer, deteriorating the image quality can also be solved and simultaneously a small size and light weight printer can be realized, solving the problem ③, because the dye reservoir of small volume can be used for supply of dye and the ink sheet is not used.

Furthermore, since this recording system employs a recording mechanism utilizing vaporization of dye and abrasion, it is no longer necessary to heat the image receiving layer of the recording sheet and the ink sheet and receiver material are not required to be pressed with a higher pressure. Therefore, the problems ④ and ⑤ can also be solved simultaneously. Since the recording head means is protected from direct contact with the recording sheet, not only the thermal fusing between the recording head means and the recording sheet is never generated in principle but also recording is possible even if the compatibility of both dye and image receiving layer resin is small. Therefore, range of design and selection of dye and image receiving layer resin can be widened remarkably, solving the problem ⑥.

As the dye just suitable for this system, any type of dye can be used, if it has adequate vaporization velocity or abrasion velocity, exists as a fluid at the temperature of 200° C. or less under the independent or mixed condition and has the required and sufficient heatproof property. In practical, a dispersed dye, oil-soluble dye, basic dye or acidic dye may be listed.

Particularly, when the abrasion mechanism is superior to the vaporization mechanism, the recording is possible even by using a dye having a heavier molecular weight and low vaporization velocity just like a direct dye, carbon black or pigment. Even in the case that the dyes having a melting point higher than the room temperature are considered, these dyes form an eutectic mixture showing a lower melting point by mixing the dyes themselves or mixing a dye and a volatile substance having a light molecular weight. Moreover, provision of adequate temperature keeping device to the recording means allows use of the dye having the melting point higher than the room temperature or a mixture of dyes.

As the photographic paper just suitable for this system, any type of paper may be used, if it has adequate compatibility with dye and functions to easily receive the dye to accelerate natural color development thereof and fix the dye used. For instance, for the dispersed dye, the paper of which surface is coated with polyester resin, polychloride vinyl resin and acetate resin, etc. having good compatibility with the dispersed dye is preferable. The dye transferred to the photographic paper may also be fixed by a method that the recorded image is heated causing the dye at the surface to penetrate into the received image.

The heating means in this recording system may be roughly classified into a method using a thermal head and a method of combining a laser beam and a material (photo-thermal conversion material) which absorbs the laser beam including the wavelength region to convert an optical energy into a thermal energy. In the case of using a laser beam, resolution can be improved remarkably and the concentric heating may be realized by raising the laser beam density with an optical system. Thereby, arriving temperature rises, providing resultant improvement in the thermal efficiency.

Particularly, a time required for recording one frame of image can be drastically shortened by utilizing a multilaser. However, the photo-thermal conversion material has to sufficiently satisfy the heat-proof characteristic in order to continuously absorb the laser beam of optical energy. Therefore, as the photo-thermal conversion material used in this system, a thin film type light absorbing material, such as a metal thin film which absorbs the wavelength of laser generated and a double-layer film of a metal thin film and a ceramic thin film having a high dielectric coefficient, can be provided in direct to the vaporizing means and moreover a dye or pigment having excellent heat-proof characteristic, such as a fine-particle type light absorbing material like carbon black and metal fine particle, etc., or an organic pigment or organic metal type pigment, etc. like naphthalocyanic pigment, naphthalocyanic pigment, cyanic pigment or anthraquinonic pigment, etc., may be dispersed uniformly into the transfer dye.

However, investigations have proved that the recording head illustrated in FIG. 17 still has the following problems to be solved.

That is, in such a thermal recording system, the dye 22 liquefied by the heat treatment is supplied, through the capillarity, to the region near the small columns 21 provided at the vaporizing means 17. The liquefied dye 22, having arrived the surface of the vaporizing means 17 by means of the capillarity as illustrated in FIG. 18, is heated by the laser beam L in the vaporizing means 17 and partially overflows therefrom under the liquid condition. Here, a phenomenon is generated that the partially overflowing liquid dye 22A is deposited on the side wall surface and the area near the aperture of the vaporizing hole 23. As a result, the predetermined vaporizing hole 23 is reduced in size to impede the normal recording. Moreover, if such condition is left as it is, the overflowing dye 22A may further be deposited to such a degree as closing the vaporizing hole 23 as indicated by a virtual line in the same figure. If it comes true, the recording may be disabled.

The inventors of the present invention have reached the following conclusion after repeated investigations about generation of undesirable phenomenon explained above.

Generation of this phenomenon depends on relationship between a surface tension of the liquid dye 22 and a critical surface tension of the protection plate 29 forming the vaporizing hole 23. Namely, the phenomenon explained previously can be prevented by using a material, for the protection plate 29, having a critical surface tension $\gamma c$ which is smaller than $\gamma$ when a surface tension of the liquid dye 22 is defined as $\gamma$. As explained above, the relationship $\gamma c<\gamma$ ensures that the liquid dye 22 is repelled by the protection plate 29, without wetting it. Therefore, it has also been found that the capillarity works to inversely return the dye 22 and accordingly if the liquid dye 22 overflows from the vaporizing means 17 as explained above, the dye 22 is no longer deposited on the wall surface of the vaporizing hole 23. The present invention has been proposed on the basis of such findings.

The present invention has been proposed considering the background explained previously and it is therefore an object of the present invention to provide a recording device and a recording method which always assures successful recording without allowing a recording material not used for the recording to be deposited on the aperture of the recording material accommodating area.

The present invention relates to a recording device of such a structure that a recording material accommodating means is comprised and a recording material is transferred to a recording object through an aperture of the recording material accommodating means, wherein at least the peripheral area of such aperture is made of a material different from the other part of the recording material accommodating means and a critical surface tension of at least the peripheral area with respect to the recording material is set smaller than a surface tension of the recording material.

In the present invention, a critical surface tension of at least the peripheral area of the aperture of the recording material accommodating means is preferably set smaller than a critical surface tension of a recording material reservoir forming the recording material accommodating means.

Moreover, in the present invention, a critical surface tension of at least the peripheral area of the aperture of the recording material accommodating means is preferably less than 20 dyn/cm.

Moreover, in the present invention, a peripheral member having a critical surface tension which is smaller than a surface tension of a recording material may be formed at the area near the aperture of the recording material accommodating means.

Moreover, in the present invention, the peripheral member may be removably attached to the aperture.

Moreover, in the present invention, the aperture is preferably be formed to have the region having a cross-sectional view which becomes smaller toward the aperture in the transferring direction of the recording material.

Moreover, in the present invention, a layer of recording material is preferably located with an gap against a recording sheet.

Moreover, in the present invention, a heat source is preferably provided in order to make the liquid recording materials to fly toward the recording sheet.

In the structure of the present invention, the heat source is preferably formed of a laser.

The present invention also relates to a recording method for realizing the recording by transferring a recording material to a recording sheet through an aperture, using the recording device explained above.

In the method of the present invention, a liquid recording material having a surface tension of 20 dyn/cm or higher is preferably used.

In the method of the present invention, at least any one of a kind of a liquid recording material used and a material of the peripheral member having a critical surface tension for the recording material which is smaller than a surface tension of the recording material can be selected.

BRIEF DESCRIPTION OF THE DRAWINGS

FIG. 14 is an enlarged perspective view separatingly indicating the base of the same embodiment and the protection plate removably mounted to the base.

DESCRIPTION OF THE PREFERRED EMBODIMENTS

The present invention will be explained in further detail depending on the preferred embodiments of the present invention, however the present invention is not naturally limited only to the preferred embodiments explained hereunder.

With reference to FIG. 3 to FIG. 6, a schematic structure of a non-contact dye vaporization type laser beam printer of a first embodiment (for example, a video printer comprising a serial type head) will be explained first.

In view of realizing multicolor printing in this dye vaporization type laser beam printer (also in the printer of the thermal recording system explained above), three pairs of printer heads (four pairs of heads in the case of additionally providing a head for black color) are prepared, for example, and these heads are provided closely for reduction in size to form a head unit for the multicolor printing.

Figure 3A:
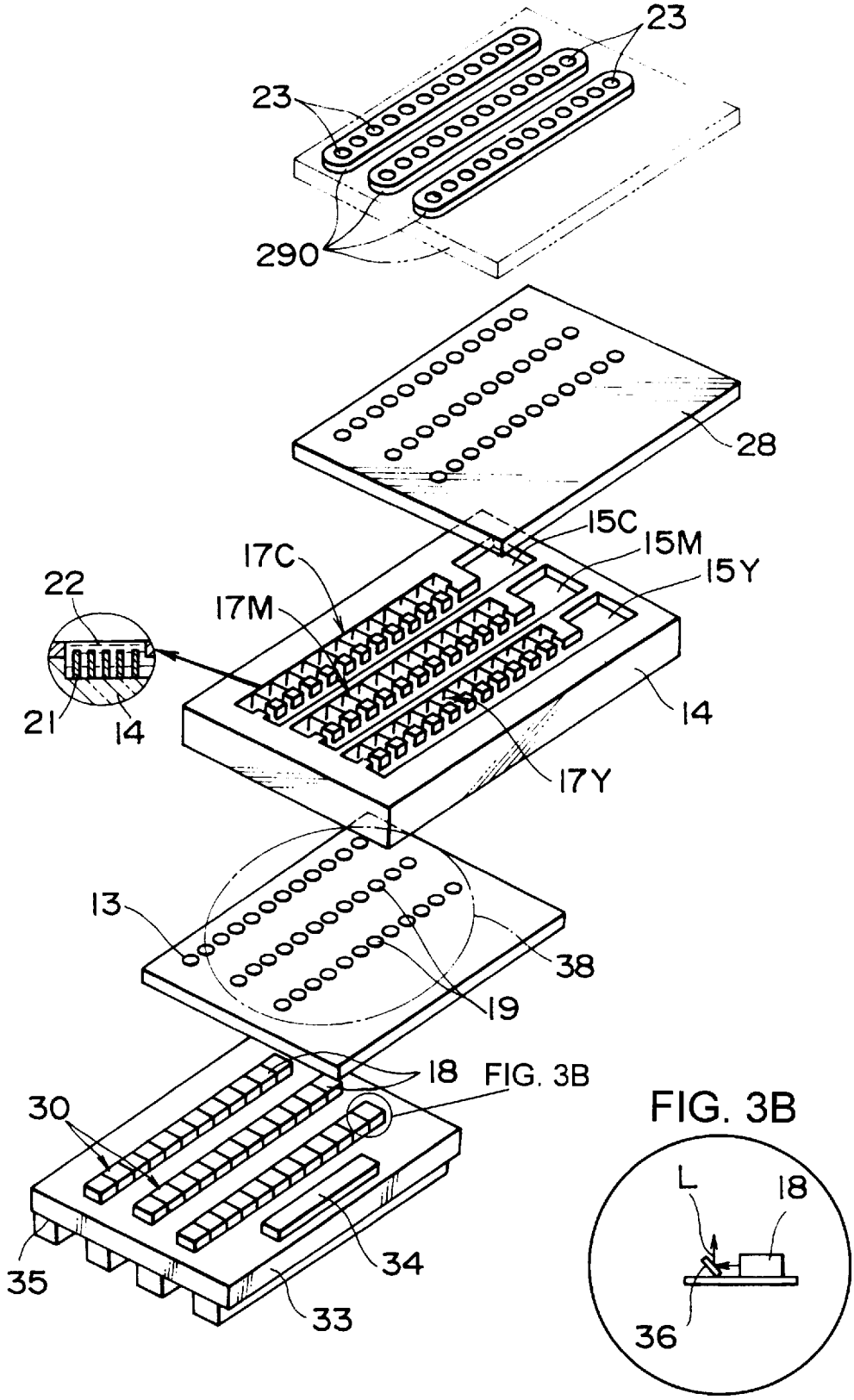
FIG. 3 is a disassembled perspective view of the recording head of the same embodiment.
Figure 4:
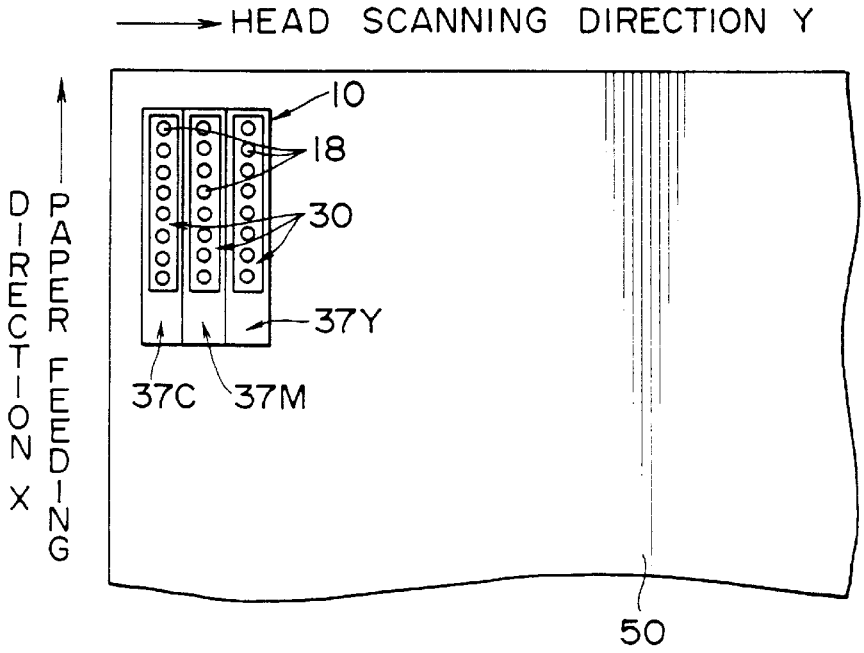
FIG. 4 is a schematic rear view indicating a printer head of the same embodiment and a scanning condition thereof.
Figure 5:
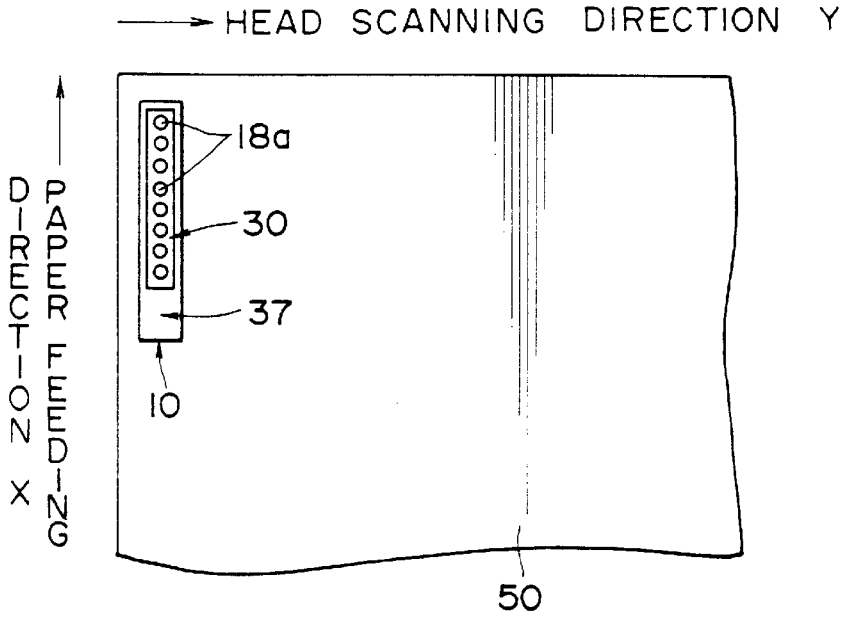
FIG. 5 is a schematic rear view indicating another printer head of the same embodiment and s scanning condition thereof.

That is, as shown in FIG. 4, three primary laser arrays for each color are provided in parallel in the head scanning direction Y. In more practical, as shown in FIG. 3, the dye reservoirs 15C, 15M, 15Y of cyan, magenta and yellow are provided on the respective bases 14 for the purpose of full-color printing to form the dye accommodation means or dye feeding head means 38C, 37M, 37Y and the dyes of respective colors are fed to the vaporizing means 17C, 17M, 17Y arranged on a line forming as many as 12 to 24 dots.

For each vaporizing means, a laser beam emitted from a multilaser array 30 formed by providing 12 to 24 corresponding lasers (particularly, semiconductor laser chips) 18 in the form of an array is respectively condensed by a microlens array 31 formed by providing many condenser lenses 19 (the reference numeral 36 defines a mirror for guiding the laser beam L in the perpendicular direction).

As a condenser lens, a lens system indicated in the figure may naturally be used but a single large diameter condenser lens 38 indicated by a virtual line may also be used. The lens 38 is formed to change a refracting path so that the beam emitting position corresponds to the vaporizing means 17C, 17M, 17Y depending on the beam incident position. The multi-laser array 30 is controllably driven by a control IC 34 provided on a substrate 33 and efficiently radiates the heat through a heat sink 35.

Figure 15:
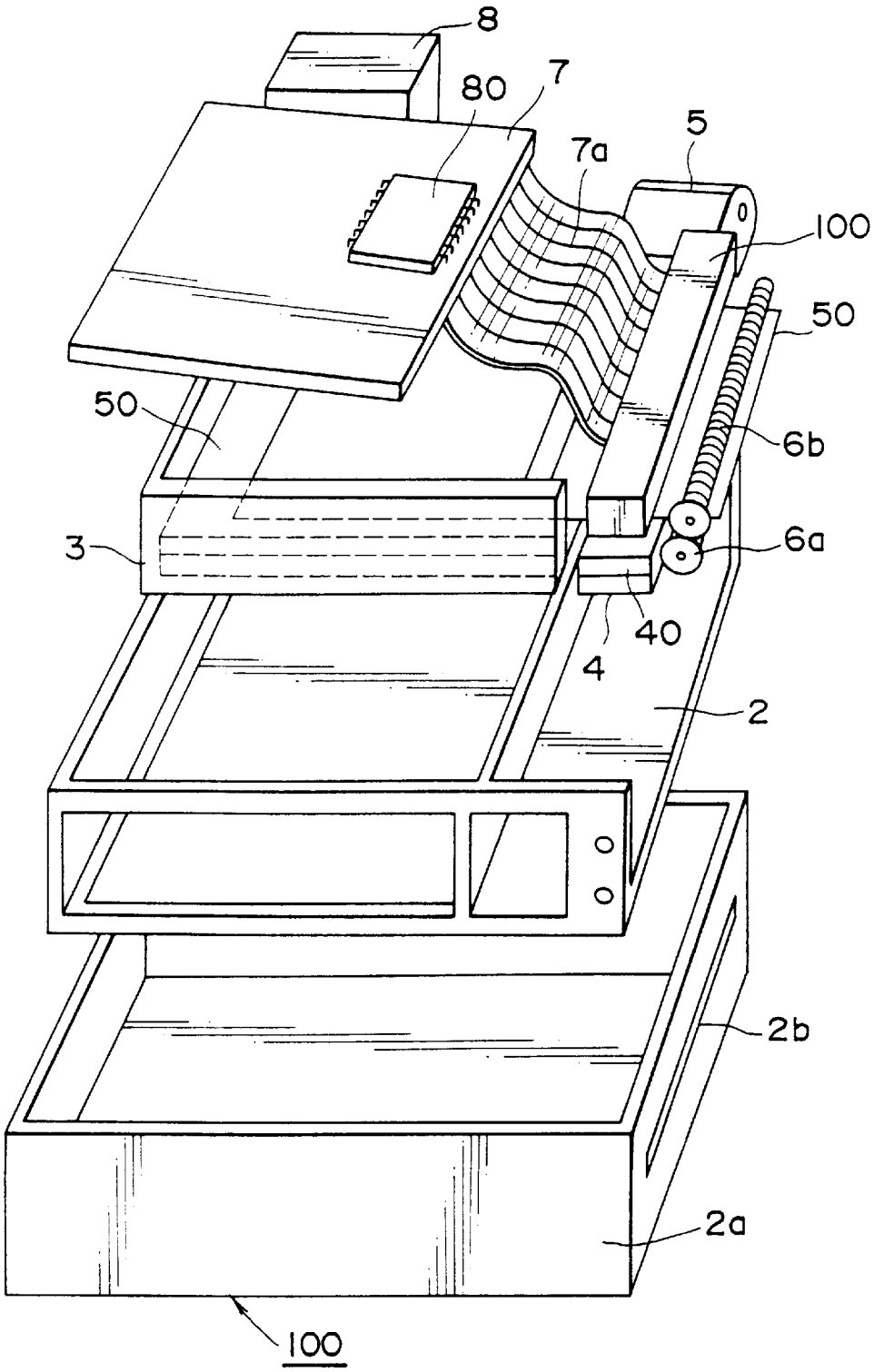
FIG. 15 is a disassembled perspective view of a printer depending on another embodiment (a line type embodiment) of the present invention.
Figure 16:
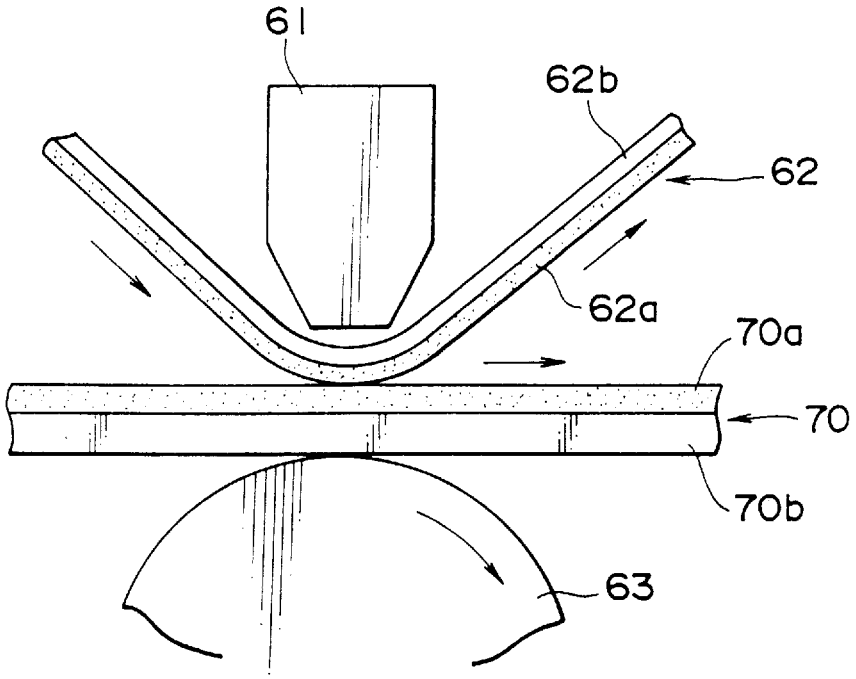
FIG. 16 is a front elevation of the essential portion of the existing printer utilizing a thermosensitive recording head.

In the case of mono-color printing, as shown in FIG. 15, a primary laser array 30 is manufactured in the structure that the respective laser elements may be operated independently or in parallel. Thereby, the printing velocity equal to or higher than the single time of the number of beams (for example, the velocity of 24 times, when the laser array of 24 beams is used) can easily be obtained.

Each printer head 10 explained above accommodates, in the form of dots, the liquid dye 22 as many as the number of recording dots in the dye accommodating means 37 and also arranges the lasers 18 in the form of an array having light emitting points 18 as many as the recording dots. Even in the thermal transfer type printer not depending on the lasers 18, the heating means of the thermal head 1 are also arranged in the form of dots.

Each printer explained above realizes the printing with the paper feeding in the vertical direction (direction X) and the scanning in the lateral direction (direction Y) of the head perpendicular to the direction X. These vertical paper feeding and lateral head scanning are alternately carried out.

Figure 6:
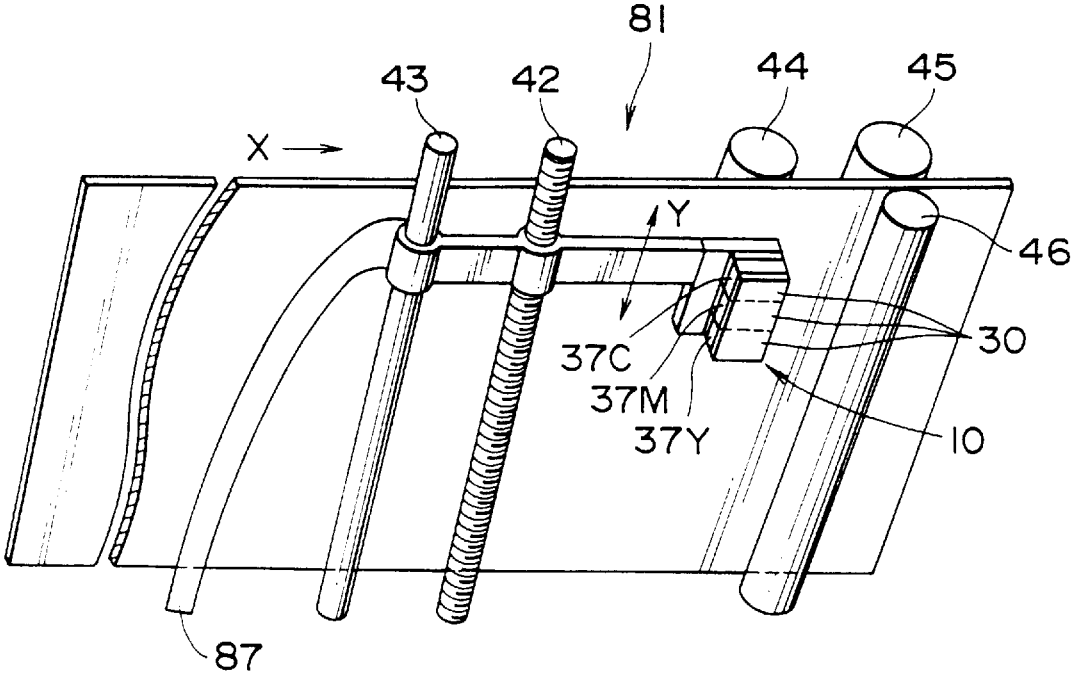
FIG. 6 is a schematic perspective view observed from the lower side of the printer of the same embodiment.

In the printer of this embodiment, the printer head 10 for multicolor printing can make the reciprocal movement in the head feeding direction Y perpendicular to the photographic paper feeding direction X by means of the head feeding shaft 42 consisting of a feed screw mechanism and the head supporting shaft 43 as shown in FIG. 6.

Moreover, at the upper side of the head 10, a head receiving roller 44 is rotatably provided to support the photographic paper 50 by holding it from both sides in combination with the head. The photographic paper 50 is held between the paper feed drive roller 45 and an inverted roller 46 to move in the paper feeding direction X.

Figure 17:
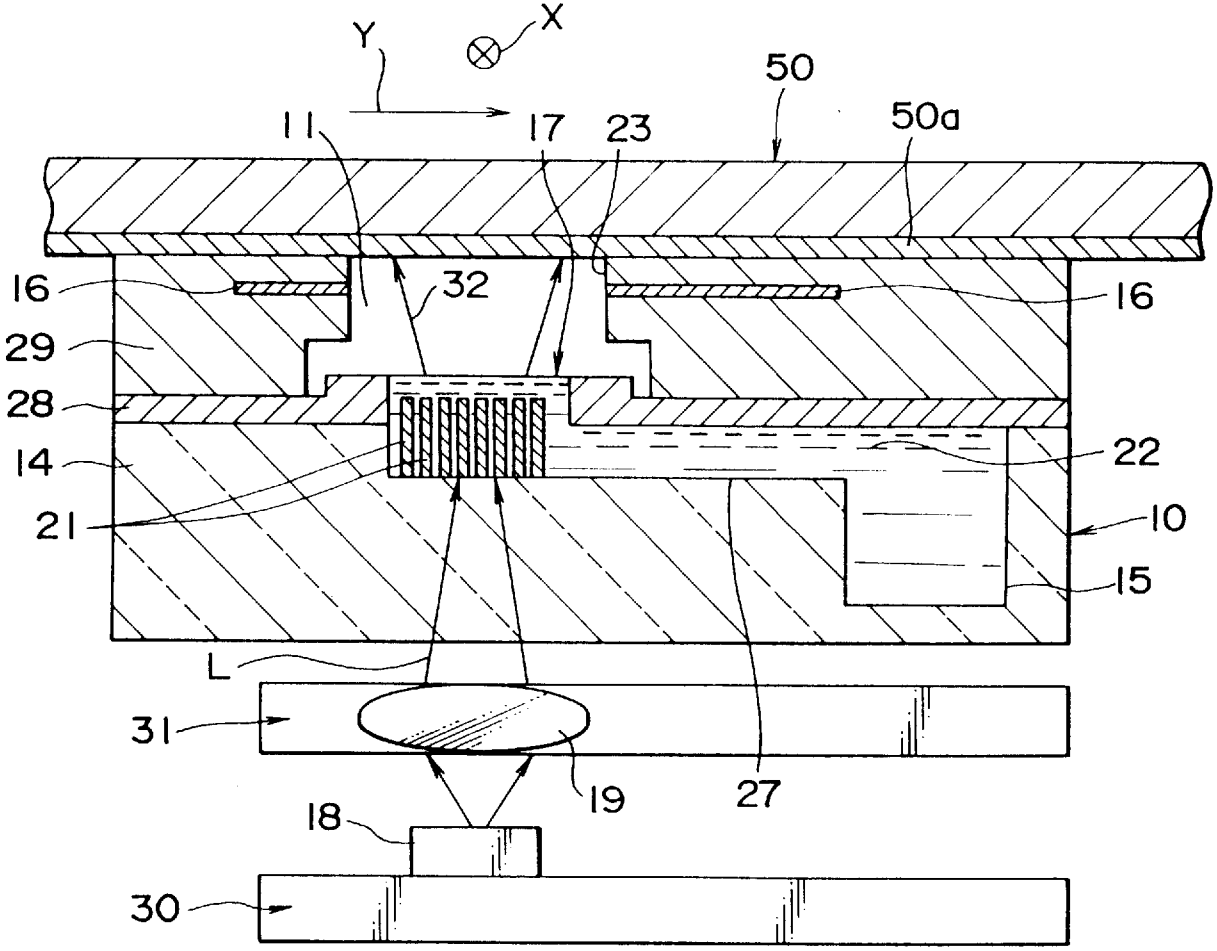
FIG. 17 is a schematic cross-sectional view of the recording head derived before accomplishment of the present invention.
Figure 18:
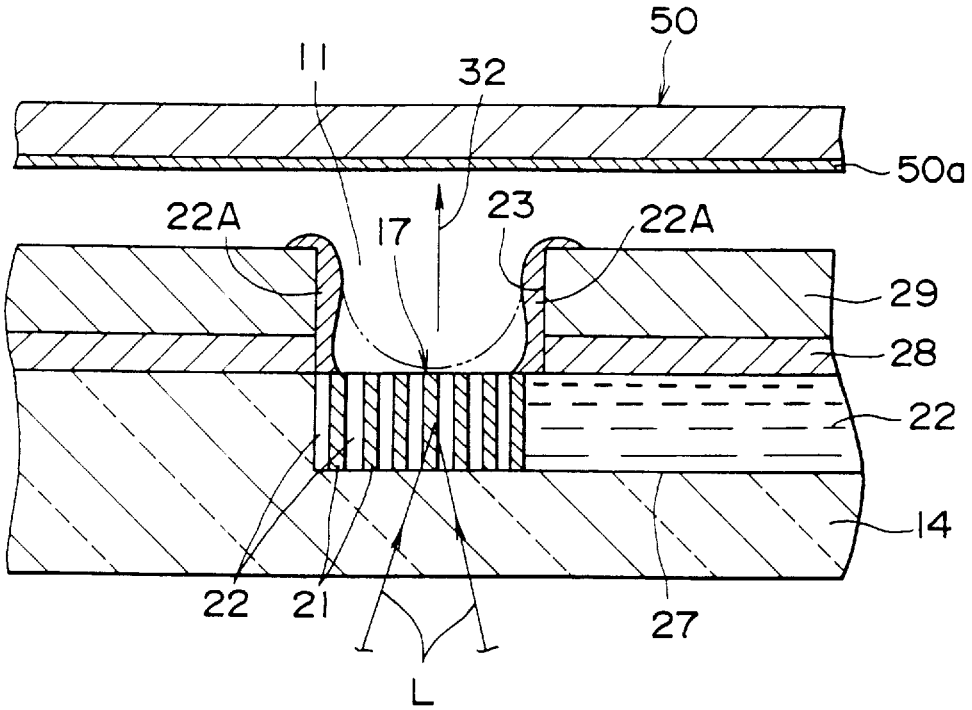
FIG. 18 is a schematic partial cross-sectional view indicating application condition of the recording head shown in FIG. 17.

The head 10 is respectively connected with a head drive circuit substrate (not illustrated) through a flexible harness 87. Moreover, the structure of the printer head 10 itself is basically same as that shown in FIG. 17.

Next, characteristics of the present embodiment will be explained hereunder.

Figure 1:
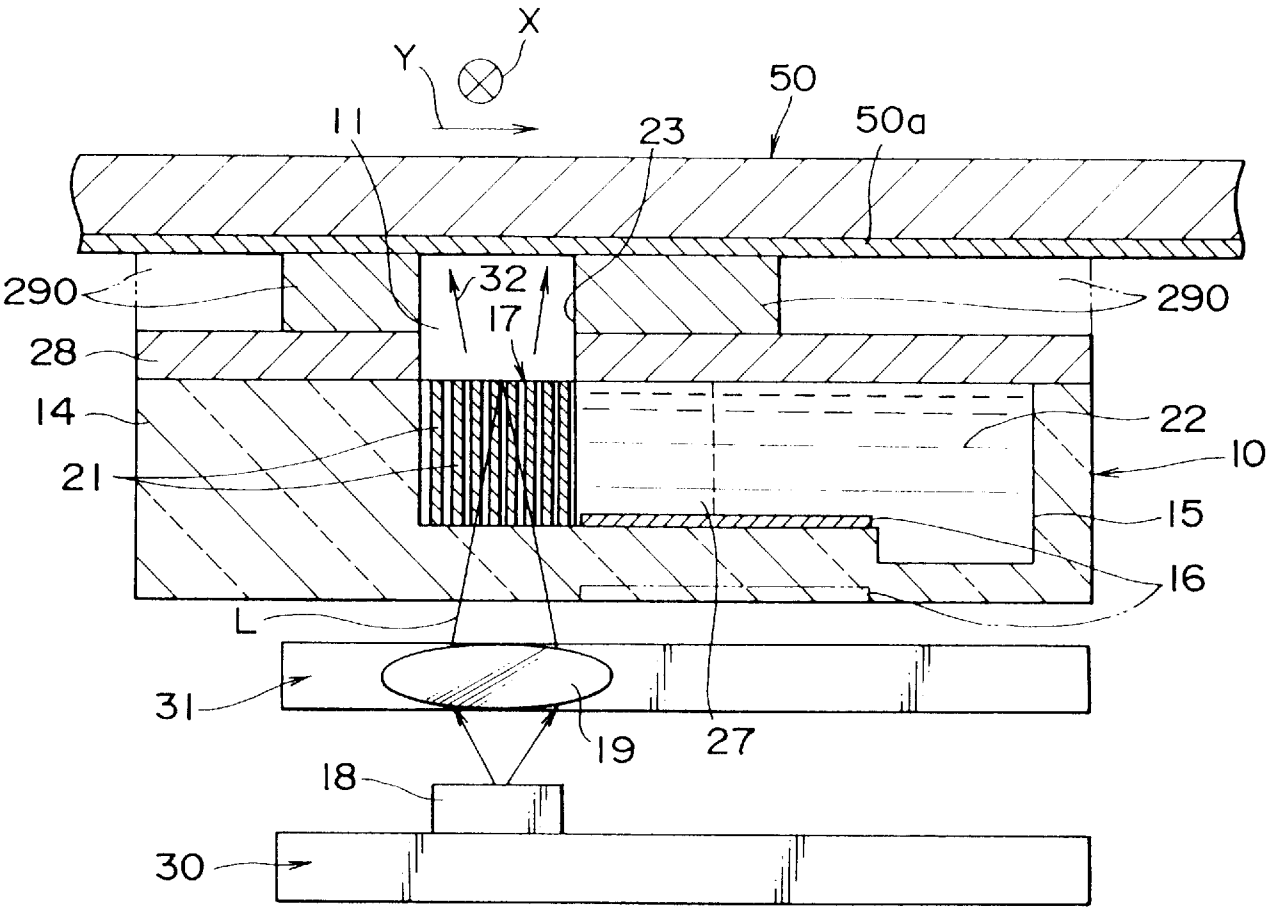
FIG. 1 is a cross-sectional view (cross-sectional view corresponding to the line I—I in FIG. 2) of a recording head depending on a first embodiment (a serial type embodiment) of the present invention.
Figure 2:
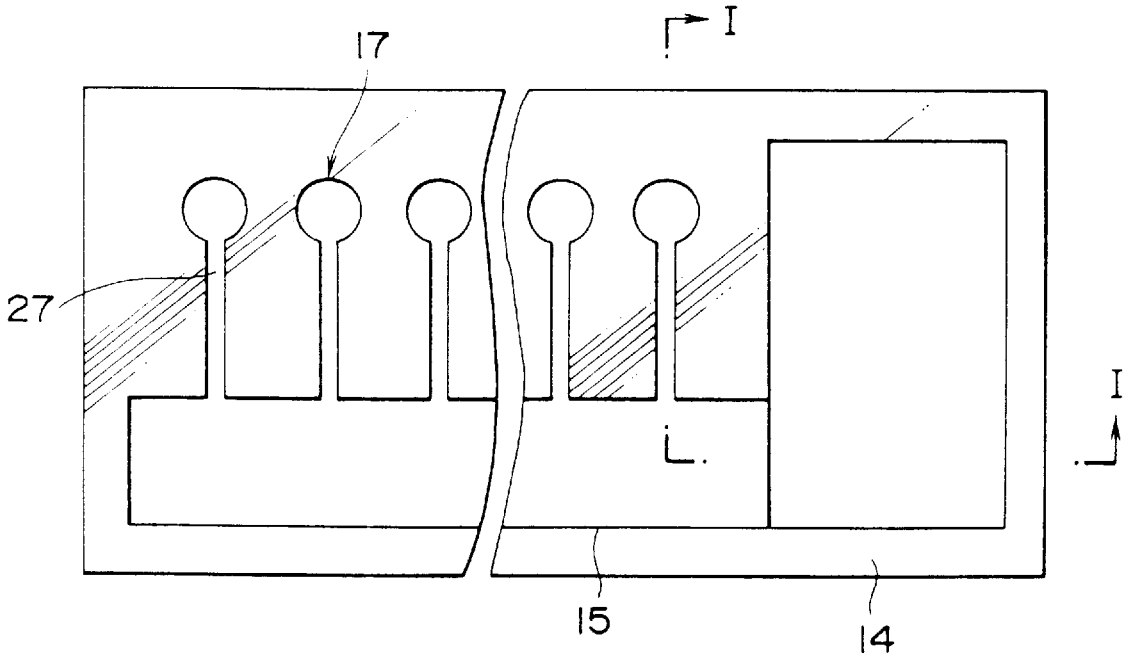
FIG. 2 is a plan view of a base of the same embodiment.

FIG. 1 illustrates a recording means of a recording unit depending on the first embodiment of the present invention which is a cross-sectional view along the line I—I of a plan view of the base 14 shown in FIG. 2. The structure itself of the printer head 10 of this embodiment is basically same as that already explained above with reference to FIG. 17. Therefore, explanation about the common part will be omitted and only the different characteristics of this embodiment will be explained below.

Here, it should be noted for the present embodiment that polytetrafluoroethylene (hereinafter referred to as Teflon) is used as a material of a protection plate 290. That is, use of the Teflon having a critical surface tension $\gamma c=18$ dyn/cm realizes the critical surface tension $\gamma c$ which is smaller than a surface tension $\gamma$ (20 dyn/cm in this embodiment) of the liquid dye 22 at 250° C. to prevent wetting of the protection plate 290 by the liquid dye 22. In FIG. 1, the reference numeral 28 defines a spacer and this space may also be made of the Teflon.

The dye 22 supplied from the dye reservoir 15 is heated by an ITO (Indium-Tin Oxide) heater 16 provided in the dye passage 27 and reaches the vaporizing means 27 by means of the capillarity through the dye passage 27 formed by the coverage of the protection plate 290 and small columns 21. When the liquid dye 22 is vaporized by irradiation of the laser beam L, the remaining dye not used for the recording is repelled by the protection plate 290 having a lower wettability (small critical surface tension $\gamma c$ ) and is never deposited on the wall surface of the vaporizing means. Thus, the recording with continuous gradation can be enabled. The heater 16 used in this embodiment may also be provided at the bottom surface of the base 14 as indicated by a virtual line. Moreover, also indicated by the virtual line, the protection plate 290 may also be provided at the entire surface of the spacer 28 and the recording dots may not be worn out by isolating the protection plate 290 and photographic paper 50 (it can also be applied to the other embodiments).

The other adequate materials may also be used, as well as Teflon, for the protection plate 290. Following materials can be listed, for example, as the material having a critical surface tension $\gamma c$ which is smaller than 20 ($\gamma c<20$).

| Name of Material | $\gamma c$ (dyn/cm) |
|---|---|
| Polypentadecafluoroactylacrylate | 10.4 |
| Polyperfluoro-t-buthylmethacrylate | 14.7 |
| Polyhepthafluorobuthylacrylate | 15.2 |
| Polyhexafluoropropylene | 16.2 to 17.1 |

Figure 7:
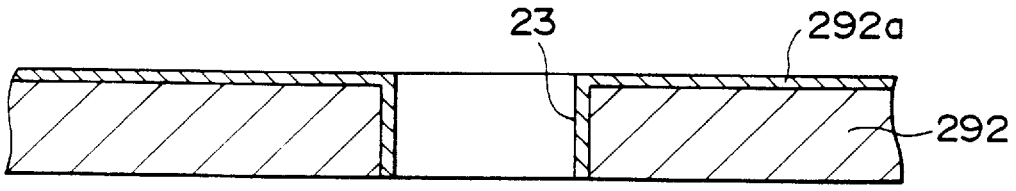
FIG. 7 is an enlarged partial cross-sectional view indicating an example of a protection plate of the same embodiment.

Moreover, as shown in FIG. 7, the protection plate can also be formed by coating (292*a*) the glass material 292 with Teflon or the materials listed above (this process may also be applied to the spacer).

In the device shown in FIG. 1, the protection plate 290 is made of Teflon (γc=18 dyn/cm) and the dye 22, which has been obtained by adding HM1225 (produced by Mitsui Toatsu Chemicals, Inc.) of 2 weight % as the laser absorbing agent to the Solvent Blue 35 having the physical material constants, γ=20 dyn/cm at 250° C. and p (density)=1.0 g/cm$^3$, has been used. The dye has been heated up to 160° C. to be fused within the vessel and is then sent to the vaporizing means 17 through the dye passage 27. Thereby, the liquid dye did not overflow from the vaporizing means.

Moreover, when the vaporizing means 17 is irradiated with a semiconductor laser beam in the emission wavelength of 780 nm and output of 40 mW, the dye has been vaporized, realizing the recording on the photographic paper 50 located through the gap of 20 μm without generation of such a phenomenon that the liquid dye left unvaporized overflows from the vaporizing means. Thereby, the recording corresponding to optical concentration of 2.2 measured with a Macbeth densitometer (illuminometer) has been realized into an area of 80 μm×80 μm of the photographic paper per 1 ms. In this case, diameter of the recording dots has been 40 μm.

Figure 8:
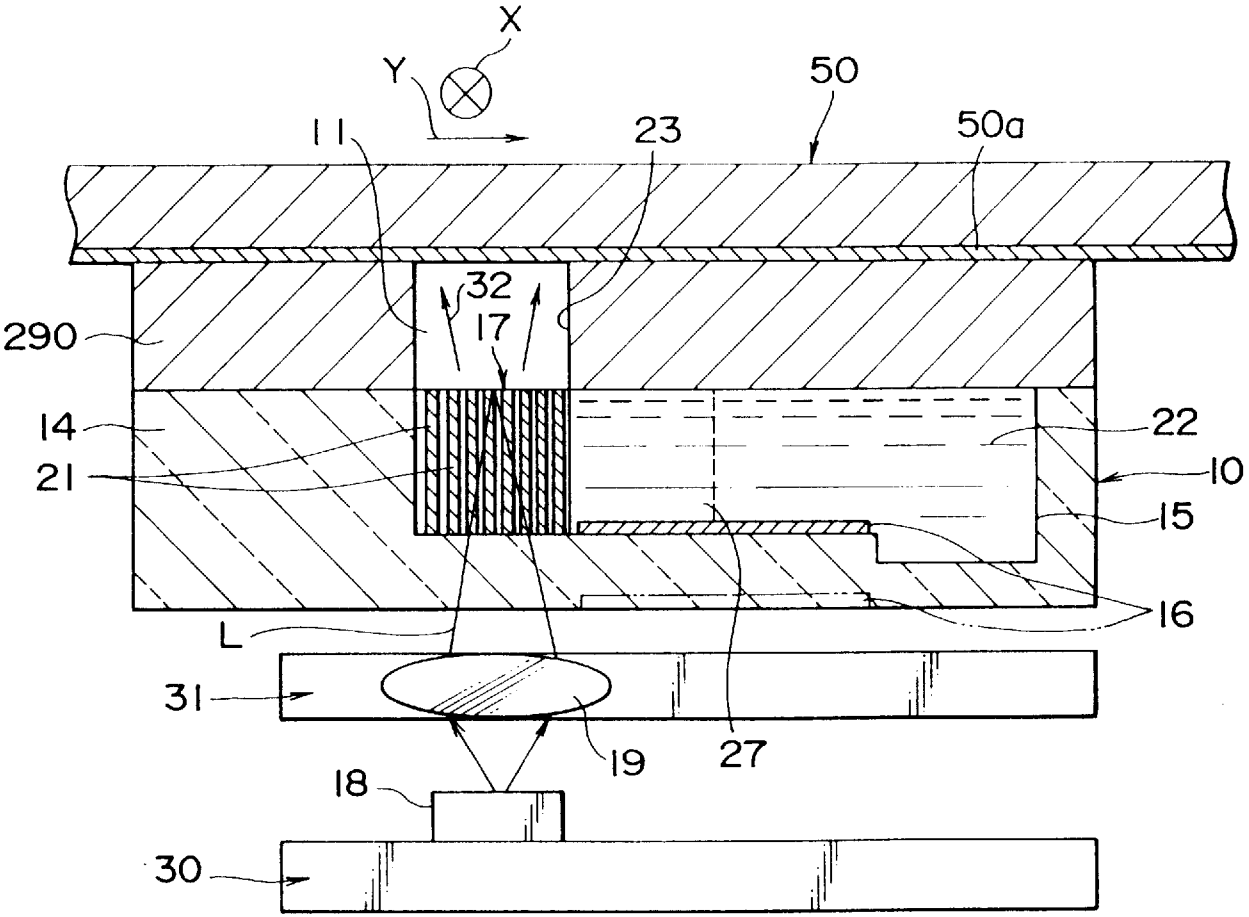
FIG. 8 is a cross-sectional view of a recording head means depending on a second embodiment (a serial type embodiment) of the present invention.

FIG. 8 is a cross-sectional view of similar to that of FIG. 1 of a recording means of the recording device depending on a second embodiment of the present invention. In this embodiment, a protection plate 290 made of Teflon is mounted in direct on the head base 14 without providing a spacer. However, in this embodiment, the protection plate 290 must be provided on the entire part of the base 14. The recording method and recording result are same as that in the first embodiment of the present invention explained previously.

Figure 9:
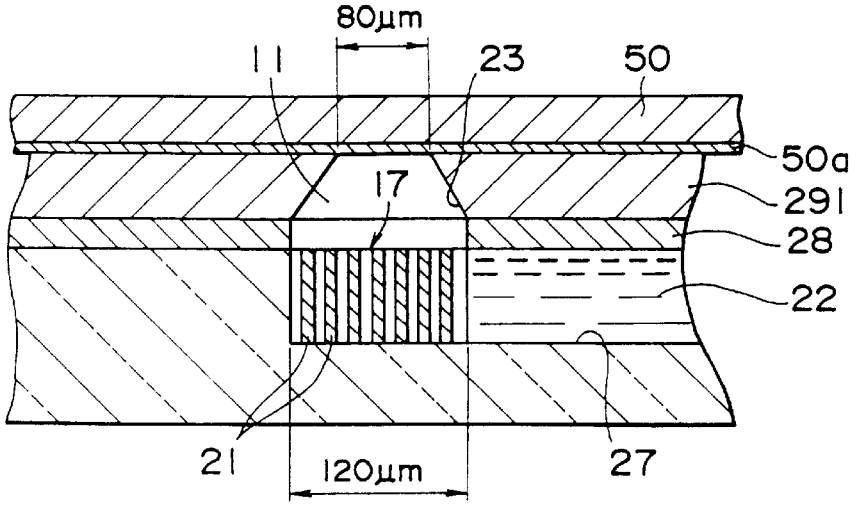
FIG. 9 is a partial cross-sectional view of a recording head depending on a third embodiment (a serial type embodiment) of the present invention.

FIG. 9 is a cross-sectional view of the essential portion of the recording means of the recording device depending on a third embodiment of the present invention. As illustrated in the figure, the vaporization hole 23 of the protection plate 291 is formed in the truncated conic shape with the upper end of aperture given the reduced diameter, however, it is rather preferable. It is because the internal circumferential surface of the vaporizing hole works as if it were a lens, thereby the vaporized dye is plotted to a very narrow region on the photographic paper and, as a result, both recording concentration and resolution are enhanced. In addition, with an inclination of the internal circumferential surface of the vaporizing hole, the remaining liquid dye is effectively repelled. Moreover, such shape increases the pressure of the liquefied dye generated by heating and thereby injection velocity of the liquid dye is increased, ensuring effective transmission of dye toward the recording sheet.

In the recording using the device illustrated in FIG. 9 in the same manner as explained above, the recording explained regarding above embodiments have been carried out within 0.5 ms without any overflow of liquid dye from the vaporizing means 17 and the recording dots in diameter of 20 μm have been formed on the photographic paper placed opposed to the head through the gap of 20 μm.

For the purpose of comparison in above respective embodiments, the recording, which has been performed under the same condition as the first embodiment (example of FIG. 1) except for only use of a glass similar to the base 14 as the material of protection plate, has proved that the liquid dye has reached the vaporizing means 17 as explained above but the liquid dye has overflown to the vaporizing means 17 together with vaporized dye due to the irradiation of the laser beam. In above recording operation, a critical surface tension γc of glass is remarkably higher than 20 dyn/cm and is also 40 dyn/cm or higher.

From above recording result, it is apparently important that the surface tension of liquid dye γ and a critical surface tension γc at the vaporizing hole of the protection plate are in the relationship that γc is smaller than γ (γc<γ).

As the structure of the part near the vaporizing hole of the protection plate, various structures may be applied, as well as that indicated in various embodiments explained above. Several examples may be listed hereunder.

Figure 10:
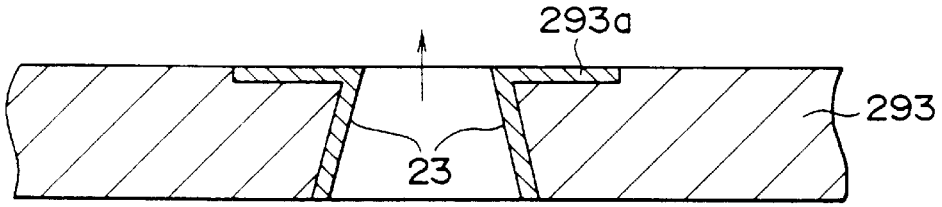
FIG. 10 is an enlarged partial cross-sectional view indicating another example of the protection plate in a serial type embodiment of the present invention.
Figure 11:
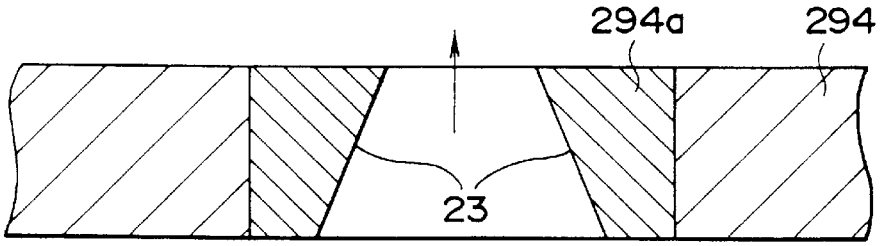
FIG. 11 is an enlarged partial cross-sectional view indicating the other example of the protection plate in a serial type embodiment of the present invention.
Figure 12:
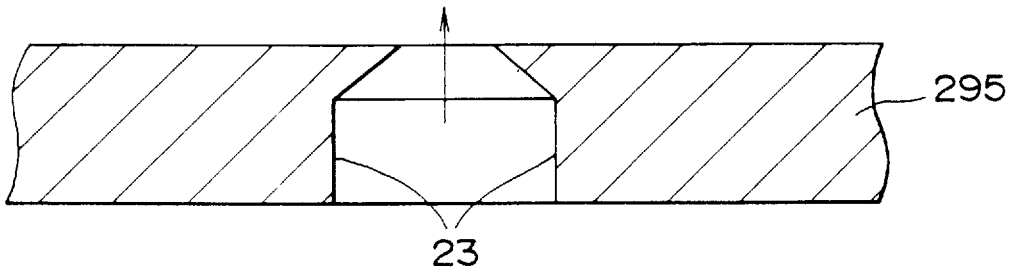
FIG. 12 is an enlarged partial cross-sectional view indicating the other example of the protection plate in a serial type embodiment of the present invention.

In FIG. 10, a material other than Teflon (glass, for example) is used for the protection plate 293 and only the region near the vaporizing hole 23 is coated with Teflon 293*a*. Moreover, in FIG. 11, only the vaporizing hole 23 of the protection plate 294 which is made of a raw material of glass is made of Teflon and this vaporizing hole 23 is fitted thereto. FIG. 12 illustrates the vaporizing hole 23 of the protection plate 295, where the diameter of only the upper end part is reduced sharply. These profiles provides the effect similar to that of the third embodiment.

Figure 13:
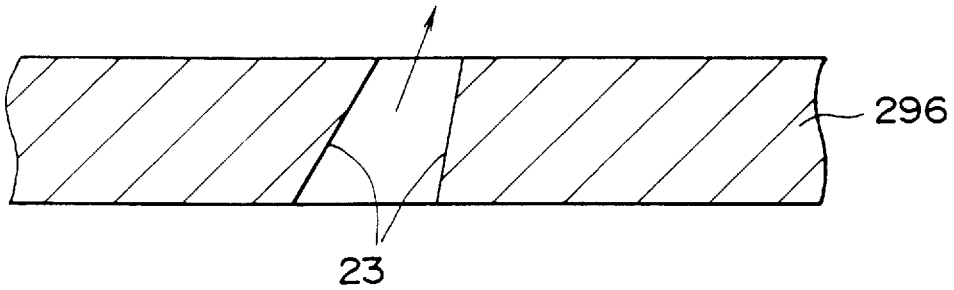
FIG. 13 is an enlarged partial cross-sectional view indicating the other example of the protection plate in a serial type embodiment of the present invention.

FIG. 13 shows the protection plate 296 where the diameter of opening end part of the vaporizing hole 23 is reduced and the hole itself is inclined toward the relative moving direction of the photographic paper provided opposed to the recording means. This example provides a merit that the recording dots may be formed easily at the predetermined positions to realize more accurate recording when the photographic paper is not moved intermittently in the microscopic view but is moved continuously. Particularly in the full-color recording, this example provides outstanding effects without any color displacement.

The protection plate may removably be mounted to the base in direct or through a spacer and is made of a material which satisfies the requirement γc<γ with respect to the dye used or the protection plate coated with such material can be selected. FIG. 14 is a disassembled perspective view of the essential portion of a recording head structured as explained above.

The protection plate 290 in this example is made of Teflon. The glass base 14 and spacer 28 may be coupled with thermal deposition of glass. The protection plate 290 can also be coupled with these elements using coupling bolts 40. In this case, for example, a clearance hole is previously bored to a part of the base 14 where is engaged with the threaded part of the bolt 40. This clearance hole is filled with unhardened resin and a bolt is inserted into this resin. After the resin is hardened, the bolt is removed to form an internal thread.

Above example is applied to a serial type recording device, but the present invention can also be applied in the same manner to a line type recording device. In the line type recording, the vaporizing means is arranged in a line for each color in such a length as single line and each vaporizing means is selectively operated while the recording sheet is transferred in the direction perpendicular to the line of vaporizing means.

FIG. 15 is a disassembled perspective view of a recording device (printer device).

In FIG. 15, the reference numeral 100 designates a non-contact laser beam thermal transfer type color video printer. A cassette 3 for accommodating a recording sheet 50 and a flat base 4 for recording are provided on a frame chassis 2 covered with a cabinet 2*a*.

A paper feed drive roller 6*a* which is driven by a motor 5 is provided in the side of recording sheet exhaust port 2*b* in the cabinet and a pressure-driven roller 6*b* is also provided to hold the recording sheet 50 with a slight pressure in combination with the paper feed drive roller 6*a*. In the upper side of the cassette 3 within the cabinet 2*a*, a head drive circuit substrate 7 mounting a drive IC 80 and a DC power supply 8 are provided. The head drive circuit substrate 7 and the head (recording means) 110 (having almost the same structure as the printer head 40 shown in FIG. 1, however, the upper and lower sides are arranged inversely) provided on the flat base 4 are connected through a flexible harness 7*a*.

The head 110 is provided with solid dye accommodation vessels 11Y, 11M, 11C for accommodating respective sublimate dyes 12Y, 12M, 12C under the solid powder condition of yellow (Y), magenta (M) and cyan (C).

The recording sheets 50 in the cassette 3 of this color video printer 1 are isolated sheet by sheet and is then supplied between the flat base 4 and head 110 and is moreover transmitted to the paper feed drive roller 6*a*.

The head 110 is pressed toward the flat base 4 with a light load (about 50 g) with a pair of light load adding springs 9, 9 through a recording sheet 50. Moreover, semiconductor laser chips 18 for three colors (Y, M, C) are arranged in three lines in parallel as many as the number of pixels. The dye of each color is heated and liquefied and supplied in the constant amount to the vaporizing means 17 from the liquid dye accommodating vessels 11Y, 11M, 11C.

When a sheet of recording paper 50 is held, under the condition explained above, by the paper feed drive roller 6*a* and the pressure-driven roller 6*b*, a dot signal is sent to the head 10 for single line and single color and the laser beam L generated by each semiconductor laser chip 18 is converted into heat. Thereby, each liquid dye is vaporized, the vaporized dyes of Y, M, C are sequentially transmitted through the gap 11 in the sequence of Y→M→C to enable the color print on the dye receiving layer 50*a* coated on the surface of the recording sheet 50 transferred between the flat base 4 and cover 20.

The examples shown in FIG. 9 to FIG. 14 can naturally be applied to the line type recording device of FIG. 15.

The preferred embodiments of the present invention have been explained above, however, the present invention allows various other modifications and changes to be added to above embodiments based on the technical concepts of the present invention.

For instance, a solid dye is once liquefied and it is then vaporized for the recording, moreover a solid dye is heated by a laser beam to vaporize in direct, namely to sublimate for the recording and furthermore the liquid dye (liquefied under the room temperature) can be accommodated in the dye accommodating vessel 11.

Moreover, the structure and shape of recording layer and head may be set to any adequate one other than those explained above and the other adequate material may also be used for each part of the head.

It is also possible that the base member is coupled with the cover, thereby the discharge port and the vaporizing means are patterned only with single process to save the process of mask alignment.

In addition, for the transfer of recording dye to the recording sheet, sublimation or abrasion (the phenomenon that a part of a substance rushes out in such a manner as boiling with the process other than the vaporization by irradiation of laser beam to continue the etching) may be utilized in addition to the vaporization of liquid dye.

Furthermore, as an energy for vaporizing or sublimating a recording material such as dye, etc., the other energies, for example, the discharge utilizing, for example, the other electromagnetic wave and stylus electrode may be used in addition to the laser beam.

In the present invention, since at least the peripheral part of the aperture of the recording material accommodating means is made of a material different from that of the other part of the recording material accommodating means and a critical surface tension of at least the peripheral part explained above against the recording material set smaller than the surface tension of the recording material, the recording material is never adhered to the aperture and its peripheral part when the recording material transfers to the recording sheet through the aperture described above.

It is because at least this peripheral part has a critical surface tension which is smaller than the surface tension of the recording material and thereby such peripheral part is never wetted by the recording material. Therefore, the recording material is never unwontedly adhered to the aperture and its peripheral part. As a result, the aperture and its peripheral part are always kept clean and transfer of the recording material to the recording sheet is never interfered, always ensuring high quality recording.

What is claimed is:

1. A recording device for depositing recording material on a recording medium, comprising:

a head base having a recording medium facing side;

a recording material reservoir in said head base;

an aperture in said head base through which ink is emitted, said aperture being in fluid communication with said reservoir; and a protection plate positioned on said head base on said recording medium facing, said protection plate having an aperture in registry with said aperture in said head base, said aperture in said protection plate being made of a material having a surface tension which is less than a surface tension of said ink;

wherein, a liquid recording material layer is located against said recording medium through said apertures.

2. A recording device according to claim 1, wherein the critical surface tension of at least the periphery of the aperture of the protection plate is under 20 dyn/cm.

3. A recording device according to claim 1, further comprising a peripheral member having a critical surface tension which is smaller than a surface tension of the recording material is provided in the periphery of the aperture of the protection plate.

4. A recording device according to claim 3, wherein the peripheral part is removably mounted to the aperture.

5. A recording device according to claim 1, wherein a heat source is provided to cause the liquid recording material to be transmitted to the recording medium.

6. A recording device according to claim 5, wherein said heat source is a laser.

7. An ink jet recording head for depositing recording material on a recording medium, comprising:

a head base having a recording medium facing side;

an ink reservoir in said head base;

an aperture in said head base through which ink is emitted, said aperture being in fluid communication with said reservoir; and a protection plate positioned on said head base on said recording medium facing side, said protection plate having an aperture in registry with said aperture in said head base, said aperture in said protection plate being made of a material having a surface tension which is less than a surface tension of said ink, said aperture in said protection plate tapering so that said aperture decreases in cross section from said head base toward said recording medium;

wherein, ink is located against said recording medium through said apertures.

8. A recording head according to claim 7, wherein the critical surface tension of at least the periphery of the aperture of the protection plate is under 20 dyn/cm.

9. A recording head according to claim 7, further comprising a peripheral member having a critical surface tension which is smaller than a surface tension of the recording material is provided in the periphery of the aperture of the protection plate.

10. A recording head according to claim 7, wherein a heat source is provided to cause the liquid recording material to be transmitted to the recording medium.

11. A recording head according to claim 10, wherein said heat source is a laser.

* * * * *